US009464335B2

(12) United States Patent
Nozaki et al.

(10) Patent No.: US 9,464,335 B2
(45) **Date of Patent: *Oct. 11, 2016**

(54) METHOD FOR IMPROVING FATIGUE STRENGTH OF CAST IRON MATERIAL

(75) Inventors: Yoshihiko Nozaki, Higashimatsuyama (JP); Makoto Taguchi, Sakado (JP); Kazuhiro Hirakawa, Ageo (JP)

(73) Assignee: UD TRUCKS CORPORATION, Ageo-shi (JP)

( * ) Notice: Subject to any disclaimer, the term of this patent is extended or adjusted under 35 U.S.C. 154(b) by 668 days.

This patent is subject to a terminal disclaimer.

(21) Appl. No.: 13/990,163

(22) PCT Filed: Oct. 31, 2011

(86) PCT No.: PCT/JP2011/075035

§ 371 (c)(1),
(2), (4) Date: May 29, 2013

(87) PCT Pub. No.: WO2012/073631

PCT Pub. Date: Jun. 7, 2012

(65) Prior Publication Data

US 2013/0263980 A1 Oct. 10, 2013

(30) Foreign Application Priority Data

Nov. 30, 2010 (JP) ..... 2010-266054

(51) Int. Cl.
*C21D 5/00* (2006.01)
*C21D 7/06* (2006.01)
(Continued)

(52) U.S. Cl.
CPC . *C21D 5/00* (2013.01); *C21D 7/06* (2013.01); *C21D 9/00* (2013.01); *C21D 9/30* (2013.01);
(Continued)

(58) Field of Classification Search
CPC ..... C21D 5/00
See application file for complete search history.

(56) References Cited

U.S. PATENT DOCUMENTS 9,102,992 B2 * 8/2015 Nozaki ..... B24C 1/10
2013/0247633 A1 * 9/2013 Nozaki ..... B24C 1/10 72/53

FOREIGN PATENT DOCUMENTS

JP 56116853 A * 9/1981
JP H9-87795 3/1997
(Continued)

OTHER PUBLICATIONS

International Search Report for International Application No. PCT/JP2011/075035 dated Jan. 17, 2012.

*Primary Examiner* — Jessee Roe
*Assistant Examiner* — Christopher Kessler
(74) *Attorney, Agent, or Firm* — Kratz, Quintos & Hanson, LLP

(57) ABSTRACT

The purpose of the present invention is to provide a method for improving fatigue strength that is capable of improving the fatigue strength of cast iron, specifically spherical graphite cast iron, to the same level as that of carbon steel subjected 10 carburizing and quenching. To this end, this method contains a step for performing first, second and third shot peenings using shot of a prescribed diameter for each on spherical graphite cast iron on which a quenching and tempering heat treatment or austempering heat treatment has been performed and tensile strength made to be 1200 MPa or more, the spherical graphite cast iron containing the following elements in the following mass percentages: C=2.0-4.0%, Si=1.5-4.5%, Mn=2.0% or less, P=O.08% or less, 8=0.03% or less, Mg=0.02-0.1%, and Cu=1.8-4.0%.

1 Claim, 5 Drawing Sheets

(51) Int. Cl.

| | |
|---|---|
| ***C21D 9/00*** | (2006.01) |
| ***C21D 9/30*** | (2006.01) |
| ***C21D 9/32*** | (2006.01) |
| ***C23C 8/02*** | (2006.01) |
| ***C22C 33/08*** | (2006.01) |
| ***C22C 37/04*** | (2006.01) |
| ***C22C 37/10*** | (2006.01) |

(52) U.S. Cl.

CPC ..... *C21D 9/32* (2013.01); *C22C 33/08* (2013.01); *C22C 37/04* (2013.01); *C22C 37/10* (2013.01); *C23C 8/02* (2013.01)

(56) References Cited

FOREIGN PATENT DOCUMENTS

| | | | |
|---|---|---|---|
| JP | H9-217142 | | 8/1997 |
| JP | H9-279229 | | 10/1997 |
| JP | H11-62945 | | 3/1999 |
| JP | H11-207522 | | 8/1999 |
| JP | 2000-239780 | | 9/2000 |
| JP | 2005-8913 | A1 | 1/2005 |
| JP | 2007-307678 | A1 | 11/2007 |
| JP | 2009-191342 | A1 | 8/2009 |

* cited by examiner

| SHOT PARTICLE SIZE (mm) | 0. 8 | 0. 9 | 1. 0 | 1. 1 |
|---|---|---|---|---|
| FATIGUE STRENGTH | ○ | × | × | × |

| SHOT PARTICLE SIZE (mm) | 0. 3 | 0. 4 | 0. 5 |
|---|---|---|---|
| FATIGUE STRENGTH | × | × | ○ |

| SHOT PARTICLE SIZE (mm) | 0. 3 | 0. 4 | 0. 5 |
|---|---|---|---|
| FATIGUE STRENGTH | ○ | × | × |

| SHOT PARTICLE SIZE (mm) | 0. 01 | 0. 07 | 0. 1 |
|---|---|---|---|
| FATIGUE STRENGTH | × | × | ○ |

| | |
|---|---|
| Z | ○ : GOOD IN TOUCH AND SLIDING PROPERTIES BETWEEN ENGAGEMENT SURFACES |
| Y | × : GENERATION OF PITCHING IN ENGAGEMENT GEAR SURFACES |

METHOD FOR IMPROVING FATIGUE STRENGTH OF CAST IRON MATERIAL

TECHNICAL FIELD

The present invention relates to a technology for improving a fatigue strength of a cast iron material, in particular, a spherical graphite cast iron.

BACKGROUND ART

A conventional automobile transmission gear has been manufactured by carburizing and hardening a steel material after the steel material was gear cut. However, there was a problem of deformation of a member due to heat treatment strain.

By contrast, a spherical graphite cast iron can be readily manufactured. However, it has a disadvantage that it can not be used in an automobile transmission gear because of a low fatigue strength. Accordingly, it is desired for a cast iron material which was not carburized and not hardened so as to have a fatigue strength being the same as that of a carburized and hardened steel material.

A spherical graphite cast iron has a high mechanical strength in cast irons. As a technology for improving a fatigue strength of a spherical graphite cast iron, there is an austempering treatment applying to a spherical graphite cast iron containing, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu.

The bending fatigue strength at $10^7$ cycles of a spherical graphite cast iron having such the composition is shown in FIG. 13. As shown in a rotating bending test curve L of FIG. 13 where a stress (MPa) is shown in a vertical axis and the number of times of repetition of bending is shown in a horizontal axis, even a high tensile cast iron having a tensile strength such high as 1400 MPa only has a fatigue strength of about 200 MPa. This numerical value is comparable to that of a forged article, and the strength of 600 MPa or more being the same level as that of a carburized and hardened steel material is not obtained.

The fatigue strength of "about 200 MPa" can not be used in an automobile transmission gear.

As an another prior art, a technology is proposed, according to which a spherical graphite cast iron is cast to improve the fatigue strength thereof by means of adding an additive to a molten metal of a flake graphite cast iron (see Patent Document 1).

However, such the prior art intends to improve the fatigue strength by improving a casting step and can not improve the fatigue strength of a material after a cast iron material was mechanically machined.

PRIOR ART DOCUMENT

Patent Document

Patent Document 1: Japanese Patent Application Non-examined Publication No. 2005-8913

SUMMARY OF THE INVENTION

Problem that the Invention is to Solve

The present invention was proposed in view of problems of above-described prior arts, and intends to provide a method for improving a fatigue strength, which can improve the fatigue strength of a cast iron material, in particular, a spherical graphite cast iron to a value the same as that of a carbon steel that was carburized and hardened.

Means for Solving the Problems

A method for improving a fatigue strength of a cast iron material of the present invention, contains the steps of Performing a first shot peening treatment with shots having the hardness of 600 Hv or more and a particle size (ϕ) of 0.5 to 0.8 mm (1 step), performing a second shot peening treatment with shots having the hardness of 600 Hv or more and a particle size (ϕ) of 0.1 to 0.3 mm (2 step), and performing a third shot peening treatment with shots having the hardness of 600 Hv or more and a particle size (ϕ) of 0.1 mm or less (3 step)

for each on spherical graphite cast iron on which quenching and tempering heat treatment or austempering heat treatment has been performed and tensile strength made to be 1200 MPa or more, the spherical graphite cast containing the following elements in the following mass percentages: C=2.0-4.0%, Si=1.5-4.5%, Mn=2.0% or less, P=0.08% or less, S=0.03% or less, Mg=0.02-0.1%, and Cu=1.8-4.0% Cu.

Upon applying the present invention, it is preferred that, after performing the first to third shot peening treatments, a shot peening treatment is performed with shots composed of tin or molybdenum to perform metal lubrication.

Advantages Effects of Invention

In result of an experiment being carried by the inventor, in a case that the first to third shot peening treatments are performed with respect to a spherical graphite cast iron that contains, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu, quenching and tempering heat treatment has been performed to the spherical graphite cast iron and that the tensile strength made to be 1200 MPa or more, the fatigue strength of 350 MPa or more can be obtained, which strength is the bending fatigue strength being the same level as that of carburized and hardened steel material.

Also, in result of an experiment being carried by the inventor, in a case that the first to third shot peening treatments are performed with respect to a spherical graphite cast iron that contains, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu, an austempering heat treatment has been performed to the spherical graphite cast iron and the tensile strength made to be 1200 MPa or more, the fatigue strength of 350 MPa or more can be obtained, which strength is the bending fatigue strength being the same level as that of carburized and hardened steel material.

According to the present invention, a compressive residual stress distribution about 600 MPa can be imparted for a range of 100 μm from a surface by performing the first to third shot peening treatments, generations of fine cracks on a surface of a spherical graphite cast iron and development of the cracks are retarded, and therefore, the fatigue strength is improved.

According to the present invention, by subjecting a predetermined machine process (for example, a gear-cutting process for an automobile transmission gear) to a spherical graphite cast iron, which contains, by weight ratio, 2.0 to 4.0% C, 1.5 to 4.5% Si, 2.0% or less Mn, 0.08% or less P, 0.03% or less S, 0.02 to 0.1% Mg, and 1.8 to 4.0% Cu, quenching and tempering heat treatment or austempering heat treatment has been performed and the tensile strength made to be 1200 MPa or more, and after, by performing the first to third shot peening treatments to the spherical graphite cast iron, the bending fatigue strength being the same level as that of a carburized and hardened steel material can be obtained, without performing a carburizing and hardening treatment.

Further, since it is not necessary to carry out a heat treatment after machine processing, the heat treatment strain can be prevented.

DESCRIPTION OF EMBODIMENTS

Hereinafter, with reference to accompanying drawings, an embodiment of the present invention will be described.

At first, with reference to FIG. 1, a work procedure in an illustrated embodiment will be described.

Figure 1:
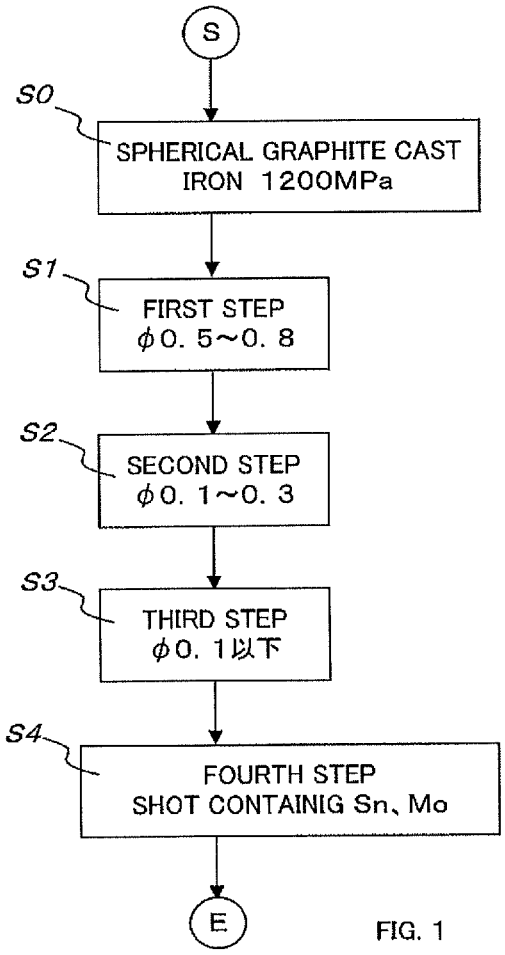
FIG. 1 is a drawing showing a procedure of a method for improving a fatigue strength of the present invention.

In FIG. 1, a spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, is subjected to quenching and tempering heat treatment or austempering heat treatment so as to make the tensile strength to be 1200 MPa or more (step S0).

Then, a shot peening treatment is performed (conducted) with shots having hardness of 600 Hv or more and a particle size ϕ of 0.5 to 0.8 mm (step S1: a step for performing a first shot peening treatment: first step).

Next, a shot peening treatment is performed with shots having hardness of 600 Hv or more and a particle size ϕ of 0.1 to 0.3 mm (step S2: a step for performing a second shot peening treatment: second step).

Then, a shot peening treatment is performed with shots having hardness of 600 Hv or more and a particle size ϕ of 0.1 mm or less (step S3: a step for performing a third shot peening treatment: third step).

Thereafter, with tin or molybdenum shots having an appropriate hardness and particle size, a shot peening treatment is performed (step S4: a step for performing a fourth shot peening treatment: fourth step).

According to the step S4, on a surface of a workpiece on which the first to third shot peening treatments were performed, metal lubrication can be performed.

In addition, the step S4 may be omitted.

According to said step S4, an effect is advantageously imparted that a surface being flattened by the third shot peening treatment is further metal lubricated.

Said step S4 is not an indispensable step and can be omitted in order to reduce steps and necessary time period of a whole process.

Figure 3:
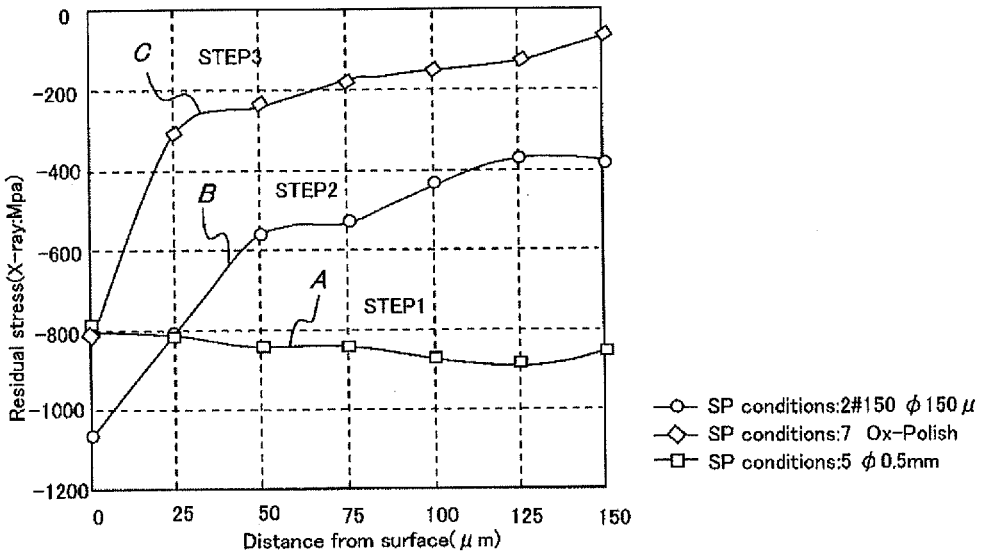
FIG. 3 is a depth from a material surface-residual stress line chart, which shows a residual stress distribution when each of the first to third shot peening treatments was conducted.

From a test sample being performed the first to third shot peening treatments (1 to 3 steps) thereon, a fatigue test sample shown in FIG. 3 was manufactured.

In an illustrated Embodiment, a shape of a test piece which is entirety shown by a character 12 comprises, for example, in a round bar 3 having an outer diameter of 12 mm, a recess 5 being a grooved in a sectional shape of character V and extending around an entire periphery in a circumference direction. At a bottom 5*a* of a recess 5, a diameter of a round bar 3 is 8 mm. Here, a test piece 12 shown in FIGS. 5(*a*) and 5(*b*) has a shape the same as that of a general test piece.

With such the test piece 13, a rotating bending fatigue test was performed.

As below-mentioned in Experimental Example 1, the fatigue strength of a spherical graphite cast iron to which the shot peening treatments of steps S1 to S3 of FIG. 1 were performed has the bending fatigue strength (for example, about 350 MPa) the same as that of a carburized and hardened steel material.

The inventors have carried out experiments (Experimental Example 1 to Experimental Example 6) such as shown below with a spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio.

Experimental Example 1

By performing the quenching and tempering heat treatment to the above-mentioned spherical graphite cast iron, the tensile strength is made to be 1200 MPa or more.

Figure 2:
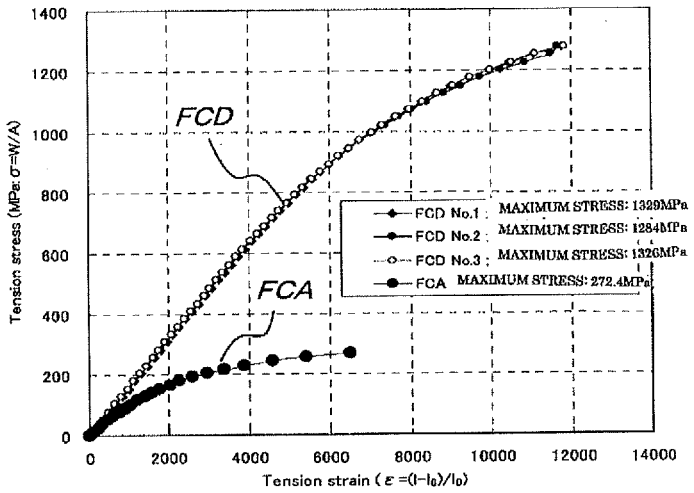
FIG. 2 is a drawing showing test results of a tensile test of test samples.

Results of a tensile test of a test sample, in which samples the quenching and tempering heat treatment applies to the spherical graphite cast iron (the quenching and tempering heat treated spherical graphite cast iron), are shown with a characteristic curve FCD in FIG. 2.

In FIG. 2, a vertical axis indicates a tensile stress (MPa) and a horizontal axis indicates a tensile strain (ϵ). Three kinds of test pieces No. 1 to No. 3 all have the maximum tensile stresses of 1200 MPa or more. A characteristic curve FCA, that is shown as a reference, shows tensile stress (MPa)-tensile strain (ϵ) characteristics in a cast iron and the maximum tensile stress was 272.4 MPa.

Next, with shots having hardness of 600 Hv or more and a particle size (ϕ) of 0.5 to 0.8 mm, a first shot peening treatment was performed. Results of the first shot peening treatment are shown as a residual stress distribution curve A in FIG. 3 (a residual stress distribution curve after the first shot peening treatment: a characteristic curve having a plot of "□").

According to a residual stress distribution curve A, until a depth of 150 μm from a test piece surface (0 μm), a residual stress has a nearly even numerical value of −800 (MPa) while slightly increasing.

Figure 4:
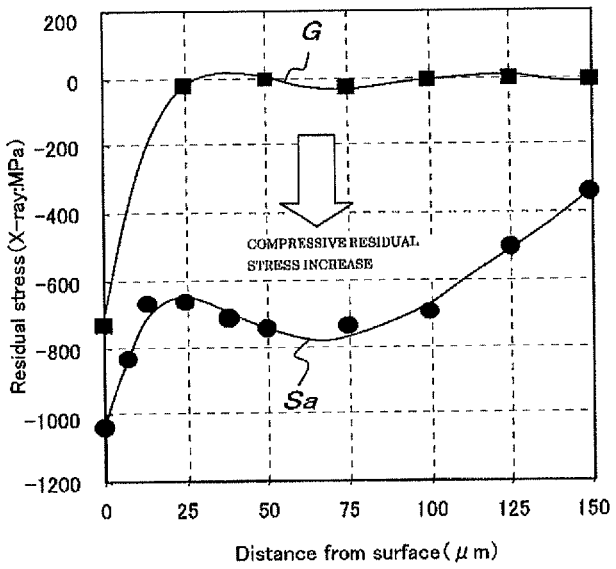
FIG. 4 is a drawing showing a distribution of compressive residual stresses after the first to third shot peening treatments were performed.

In FIGS. 3 and 4, a vertical axis shows a numerical value of the residual stress. Therefore, in FIGS. 3 and 4, in a case that a numerical value of the compressive residual stress is high, it is shown in a lower part (on a side where a negative absolute value is large).

On a test piece differing to said test piece from which a residual stress distribution curve A in FIG. 3 has been obtained, a second shot peening treatment was performed with shots having a hardness of 600 Hv or more and a shot particle size (ϕ) of 0.1 to 0.3 mm. Results thereof are shown in FIG. 3 as a residual stress distribution curve B (a residual stress distribution curve after the second shot peening treatment: a characteristic curve having a plot of "O").

In the residual stress distribution curve B, in an area (region) until a depth of 50 μm from a test piece surface (0 μm), a compressive residual stress rapidly increases, and in an area in a depth of 50 μm or more, a compressive residual stress slowly increases.

On a test piece further differing to said test piece from which a residual stress distribution curve A in FIG. 3 has been obtained or differing to said test piece from which a residual stress distribution curve B in FIG. 3 has been obtained, a third shot peening treatment was performed with shots having a hardness of 600 Hv or more and a shot particle size (ϕ) of 0.1 mm or less. Results thereof are shown in FIG. 3 as a residual stress distribution curve C (a residual stress distribution curve after the third shot peening treatment: a characteristic curve having a plot of "◇").

In a residual stress distribution curve C, in an area until a depth of 25 μm from a test piece surface (0 μm), a compressive residual stress rapidly increases, and in an area deeper from a surface than a depth of 25 μm, a compressive residual stress slowly increases.

A residual stress distribution thereof is shown in FIG. 4 which shows a result in a case that the first to third shot peening treatments have been performed to the same test piece.

In FIG. 4, a residual stress distribution of a test piece before the first to third shot peening treatments is performed is shown with a residual stress distribution curve G.

On the other hand, a residual stress distribution of a test piece after the first to third shot peening treatments have been performed is shown with a residual stress distribution curve Sa.

As obvious in FIG. 4, being compared with a residual stress of a test piece before the first to third shot peening treatments, a residual stress distribution of a test piece after the first to third shot peening treatments increases. Here, a gap (difference) between a residual stress distribution curve G and a residual stress distribution curve Sa corresponds to an increment of a compressive residual stress owing to the first to third shot peening treatments.

Refering to FIG. 4, it can be understood that a test piece on which the first to third shot peening treatments have been performed has an increased compressive residual stress entirely in an area from a surface to 150 μm inside, compared with compressive residual stress of a test piece on which the first to third shot peening treatments have not been performed. In FIG. 4, a gap (difference) between a residual stress distribution curve G and a residual stress distribution curve Sa corresponds to an increment of compressive residual stress.

A residual stress is such large as 1000 MPa at a surface 0 μm and as about 700 MPa in an area from 25 μm to 100 μm. Also in an area (region) more inside than 100 μm, a test piece on which the first to third shot peening treatments have been performed has an increased compressive residual stress, compared with compressive residual stress of a test piece on which the first to third shot peening treatments have not been performed.

Figure 5:
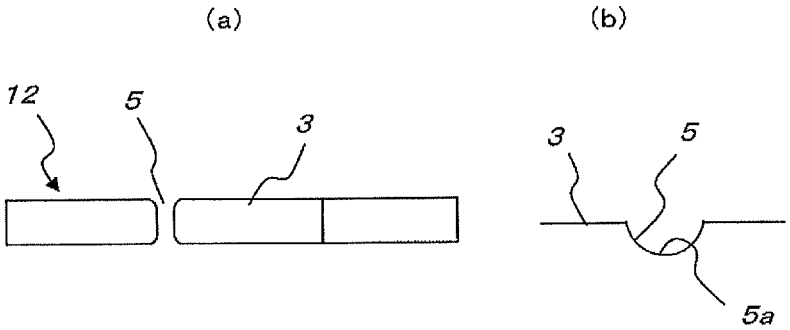
FIG. 5 is a drawing showing a test piece being used in bending fatigue tests.
Figure 6:
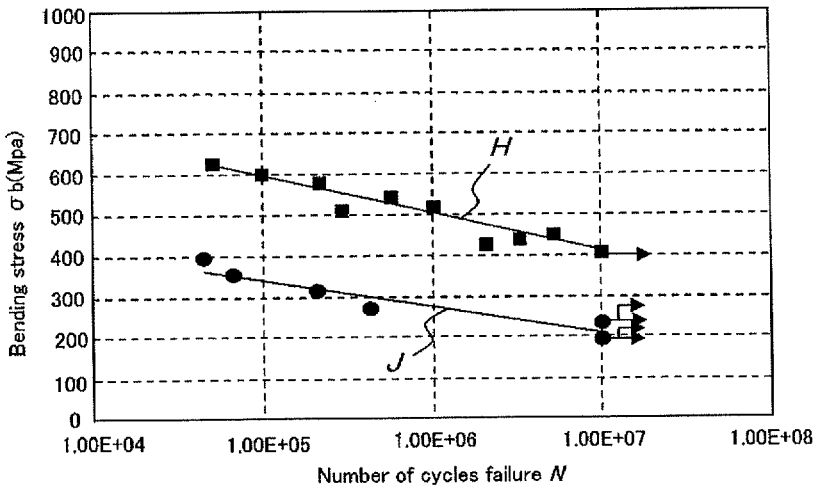
FIG. 6 is a drawing showing test results of rotating bending fatigue tests in Experimental Example 1.

In Experimental Example 1, the first to third shot peening treatments were performed on the same test piece, a fatigue test piece shown in FIGS. 5(*a*) and 5(*b*) was manufactured from the material (the test piece), and the rotating bending fatigue test (JIS Z 2274) was performed thereon. Results of such the fatigue test are shown in FIG. 6. In FIG. 6, a vertical axis indicates (shows) a bending stress (σ: MPa), and a horizontal axis indicates the number of times of repetition (N).

A mark H in FIG. 6 shows a characteristics curve of the bending fatigue strength of a test piece to which the first to third shot peening treatments were performed in Experimental Example 1.

It was found in FIG. 6 that a test piece according to Experimental Example 1 has a bending fatigue strength the same as that of a carburizing and quenching steel (about 350 MPa).

A bending fatigue curve J in FIG. 6 shows a bending fatigue curve of a high tensile cast iron of FCDI 1400 MPa on which a shot peening treatment has not been performed. Said bending fatigue curve J is shown also in FIG. 13.

In Experimental Example 1, from results shown in FIG. 6, it was found that the bending fatigue strength being generally the same as that (about 350 MPa) of a carburized and hardened low carbon steel material can be obtained, by applying quenching and tempering heat treatment to the spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, so as to impart the tensile strength of 1200 MPa or more, and then, performing the first to third shot peening treatments thereto.

Further, from a compressive residual stress distribution shown in FIG. 3, it was found that when the first shot peening treatment is omitted, a compressive residual stress is decreased in an area deeper by 25 μm or more from a surface decreases, and when the second shot peening treatment is omitted, a compressive residual stress in an area until 25 μm from a surface is decreases.

Experimental Example 2

In Experimental Example 2, a test material that was obtained by applying said spherical graphite cast iron to an austempering heat treatment to be made a tensile strength to be 1200 MPa or more was used.

With respect to such the test materials, in a manner the same as that of Experimental Example 1, a first shot peening treatment was performed with shots having a hardness of 600 Hv or more and with a shot particle size (ϕ) of 0.5 to 0.8 mm, to one test material, a second shot peening treatment was performed with shots having a hardness of 600 Hv or more and with a shot particle size (ϕ) of 0.1 to 0.3 mm, to the other test material, and a third shot peening treatment has been performed with shots having a hardness of 600 Hv or more and a shot particle size (ϕ) of 0.1 mm or less, to the further other test material.

Results of the above-mentioned Experimental Example 2 are the same as that shown in FIG. 3 in Example 1.

Further, with respect to the same test material, the first to third shot peening treatments have been performed and a compressive residual stress distribution in said test piece was examined. Results of said examination were the same as the results of FIG. 4 in Example 1.

With a test material on which the first to third shot peening treatments have been performed, a fatigue test piece the same as that of Example 1 was prepared, and a rotating bending fatigue test was carried out.

Figures 7, 8, 9:
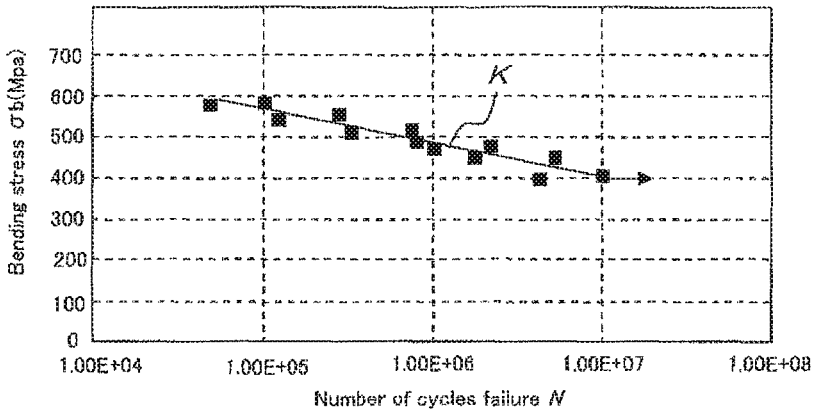
FIG. 7 is a drawing showing results of Experimental Example 2 as a table.
FIG. 8 is a drawing showing results of Experimental Example 3 as a table.
FIG. 9 is a drawing showing results of Experimental Example 4 as a table.

Results of such the fatigue test are shown in FIG. 7. In FIG. 7, a vertical axis shows a bending stress (σ) and a horizontal axis shows the number of times of repetition (N).

In FIG. 7, a fatigue curve K shows a bending fatigue strength of a test piece being performed Experimental Example 2.

As obvious from results of Experimental Example 2, it was found that when an austempering treatment is performed with respect to a spherical graphite cast iron that contains, by mass percentage, C=2.0 to 4.0%, Si=1.5 to 4.5%, Mn=2.0% or less, P=0.08% or less, S=0.03% or less, Mg=0.02 to 0.1%, and Cu=1.8 to 4.0% to impart a tensile strength of 1200 MPa or more, and the first to third shot peening treatments are performed, a bending fatigue strength being the same as that (about 350 MPa) of a carburizing and quenching steel material can be obtained.

Experimental Example 3

When a first shot peening treatment is performed with respect to a test piece used in Experimental Example 1 (the spherical graphite cast iron, which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, and was applied quenching and tempering heat treatment thereto), a fatigue test of bending fatigue strength was performed to test pieces, which is manufactured in a manner the same as that of Experimental Example 1, except that shots having a particle size larger than 0.8 mm (particle size: 0.9 mm, 1.0 mm, and 1.1 mm) were used.

In FIG. 8, results of the fatigue test when a first shot peening treatment was performed with shots having a particle size of 0.8 mm, 0.9 mm, 1.0 mm or 1.1 mm are shown. In FIG. 8, "○" shows that the fatigue strength being the same level as 350 MPa was obtained, and "X" shows that the fatigue strength did not reach about 350 MPa.

Although in a case that a shot particle size is 0.8 mm, the fatigue strength the same as that (about 600 MPa) of a carburized and hardened steel material was obtained ("○" in FIG. 8), in an other case that a shot particle size is 0.9 mm, 1.0 mm or 1.1 mm, the bending fatigue strength was 350 MPa or less ("X" in FIG. 6).

From FIG. 8, it was found that in the first shot peening treatment, a shot particle size should be set to 0.8 mm or less.

When the shot particle size is larger than 0.8 mm in the first shot peening treatment, it is considered that shots are not conveyed by an air flow when shots are blasted off, and therefore, sufficient impacts can not be imparted to the test piece.

Experimental Example 4

In a manner being similar to that of Experimental Example 1, except that shots having a particle size of 0.5 mm or smaller (particle size: 0.5 mm, 0.4 mm, 0.3 mm) were used in a first shot peening treatment, the fatigue test was performed relating to the bending fatigue strength.

In FIG. 9, "○" shows that the fatigue strength being the same level as about 350 MPa was obtained, and "X" shows that the fatigue strength did not reach about 350 MPa.

As shown in FIG. 9, in a case that a shot particle size is 0.5 mm, the fatigue strength being the same level as that (about 350 MPa) of a carburized and hardened steel material could be obtained ("○" of FIG. 9), however, in an another case that a shot particle size is 0.4 mm or 0.3 mm, the bending fatigue strength was 350 MPa or smaller ("X" of FIG. 9).

From FIG. 9, it was found that in the first shot peening treatment, a shot particle size should be set to 0.5 mm or larger.

It is considered in a case that a shot particle size is smaller than 0.5 mm in the first shot peening treatment, although the compressive stress on a surface side of a steel material becomes larger, the compressive stress inside the steel material becomes smaller.

Experimental Example 5

In a manner similar to that of Experimental Example 1, except that shots having a particle size of 0.3 mm or larger (particle size: 0.3 mm, 0.4 mm, 0.5 mm) were used in a second shot peening treatment, the fatigue test was performed relating to the bending fatigue strength.

Figures 10, 11, 12, 13:
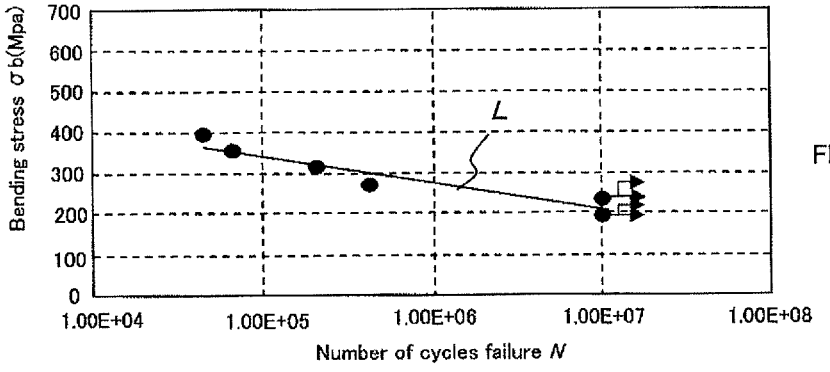
FIG. 10 is a drawing showing results of Experimental Example 5 as a table.
FIG. 11 is a drawing showing results of Experimental Example 6 as a table.
FIG. 12 is a drawing showing results of Experimental Example 7 as a table.
FIG. 13 is a fatigue strength line chart of a spherical graphite cast iron.

In FIG. 10, "○" shows that the fatigue strength being the same level as about 350 MPa was obtained, and "X" shows that the fatigue strength did not reach about 350 MPa.

As shown in FIG. 10, in a case that a shot particle size is 0.3 mm, the fatigue strength being the same level as that (about 350 MPa) of a carburized and hardened steel material could be obtained ("○" of FIG. 8), however, in an another case that a particle size is 0.4 mm or 0.5 mm, the bending fatigue strength was 350 MPa or smaller ("X" of FIG. 10).

From results of FIG. 10, it was found that in the second shot peening treatment, a shot particle size should be set to 0.3 mm or smaller.

Although the second shot peening treatment is a treatment for improving the compressive residual stress of the outermost surface (a region where a distance from a surface is 50 μm) of a cast iron test piece, it is assumed that a peak of the compressive residual stress is not generated on the most surface and the fatigue strength was not improved, in a case that a shot particle size is larger than 0.3 mm.

Experimental Example 6

In a manner similar to that of Experimental Example 1, except that shots having a particle size of 0.1 mm or smaller (particle size: 0.1 mm, 0.07 mm, 0.01 mm) were used in a second shot peening treatment, the fatigue test was performed relating to the bending fatigue strength.

In FIG. 11, "○" shows that the fatigue strength of about 350 MPa could be obtained, and "X" shows that the fatigue strength did not reach about 350 MPa.

As shown in FIG. 11, in a case that a shot particle size is 0.1 mm, the fatigue strength being the same level as that (about 350 MPa) of a carburized and hardened steel material could be obtained ("○" of FIG. 9), however, in an another case that a particle size is 0.07 mm or 0.01 mm, the bending fatigue strength was 350 MPa or smaller ("X" of FIG. 11).

From FIG. 11, it was found that in the second shot peening treatment, a shot particle size should be set to 0.1 mm or larger.

It is assumed that when a particle size of shots used in the second shot peening treatment is small, a surface of a cast iron is smoothened merely, the compressive residual stress of the outermost surface of a steel material was not generated, and the fatigue strength could not be improved.

Experimental Example 7

Gears (gears on which the first to third shot peening treatments were performed) Z being manufactured with a test material of Experimental Example 1 and gears Y being manufactured with a test material to which the third shot peening treatment was not applied, were prepared.

As to gears (gears on which the first to third shot peening treatments were performed) Z being manufactured with a test material of Experimental Example 1, the sliding properties of an engagement surface were good.

By contrast, as to gears Y being manufactured with a test material to which the third shot peening treatment was not applied, the sliding properties of an engagement surface showed abnormality.

In more detail, in FIG. 12, the gears Z were good in touch and sliding properties between engagement gear surfaces and were cleared the predetermined endurance test (shown by "○" in FIG. 12).

By contrast, the gears Y were not good in touch and sliding properties between engagement gear surfaces, generated fine cracks on a gear surface, and could not clear the predetermined endurance test (shown by "X" in FIG. 12).

From FIG. 12, it was found that the third shot peening treatment should not be omitted.

According to the third shot peening treatment, a surface being roughened by the first and second shot peening treatments is smoothened, and an irregularity of a gear surface becomes smaller; accordingly, in fine irregularity, oil stays therein to exert a lubrication operation.

It is assumed that the test material, to which the third shot peening was not applied, could not exert such the lubrication operation and that sliding abnormality was generated on an engagement surface.

Illustrated embodiments are merely examples and do not intend to limit a technical range of the present invention.

For example, illustrated embodiments can be applied to a cum of a valve operating system, con rod, and various kinds of pumps for supplying a gear high pressure oil.

EXPLANATION OF REFERENCE NUMERALS

5 ROUND BAR PORTION
6 R CURVE
7 SMALL RADIUS PORTION
13 BENDING TEST PIECE
Y GEAR PREPARED WITH MATERIAL OBTAINED BY OMITTING THIRD STEP
Z GEAR PREPARED WITH MATERIAL AFTER EXPERIMENT 1

The invention claimed is:

1. A method for improving a fatigue strength of a cast iron material, comprising the steps of:

quenching and subjecting to a tempering or austempering heat treatment a spherical graphite cast iron which contains 2.0 to 4.0% C, 1.5 to 4.5% Si, 2.0% or less Mn, 0.08% or less P, 0.03% or less S, 0.02 to 0.1% Mg, and 1.8 to 4.0% Cu, by weight ratio, so as to impart the tensile strength of 1200 MPa or more;

then performing on the spherical graphite cast iron a first shot peening treatment with shots having the hardness of 600 Hv or more and a particle size (ϕ) of 0.5 to 0.8 mm;

then performing a second shot peening treatment with shots having the hardness of 600 Hv or more and a particle size (ϕ) of 0.1 to 0.3 mm; and then performing a third shot peening treatment with shots having the hardness of 600 Hv or more and a particle size (ϕ) of 0.1 mm or less.

* * * * *